US005562315A

United States Patent [19]

Sales

[11] Patent Number: 5,562,315

[45] Date of Patent: Oct. 8, 1996

[54] DOOR RETAINER FOR PRE-HUNG DOOR

[76] Inventor: Charles R. Sales, 4243 Springrock Cir., West Linn, Oreg. 97068

[21] Appl. No.: 384,120

[22] Filed: Feb. 6, 1995

[51] Int. Cl.[6] ..... E05C 1/04

[52] U.S. Cl. ..... 292/150; 49/380

[58] Field of Search ..... 292/150, 207; 49/380

[56] References Cited

U.S. PATENT DOCUMENTS

| | | | |
|---|---|---|---|
| 305,294 | 9/1884 | Corn | 292/175 |
| D. 319,007 | 8/1991 | Rogers . | |
| 611,941 | 10/1898 | Robertson | 292/150 |
| 2,706,837 | 4/1955 | Jackson . | |
| 2,720,308 | 10/1955 | Howell . | |
| 2,728,956 | 1/1956 | Jackson . | |
| 2,730,723 | 1/1956 | Logue . | |
| 2,927,352 | 3/1960 | Chenoweth | 49/380 |
| 3,430,385 | 3/1969 | Biro | 49/380 |
| 3,593,458 | 7/1971 | Wahlfield . | |
| 4,151,681 | 5/1979 | Roberts . | |
| 4,483,101 | 11/1984 | Berzina . | |
| 4,718,195 | 1/1988 | Ortega | 49/380 |
| 5,159,782 | 11/1992 | Sales | 49/380 |
| 5,209,017 | 5/1993 | Ridge | 49/380 |
| 5,365,697 | 11/1994 | Vanderpan | 49/380 |

*Primary Examiner*—Steven N. Meyers
*Assistant Examiner*—Donald J. Lecher
*Attorney, Agent, or Firm*—Robert L. Harrington

[57] ABSTRACT

A retainer for securing and retaining a pre-hung door unit in a closed position relative to a door jamb assembly. The retainer includes a shaped cylindrical plug configured to fit closely in the edge bore of the door. A configured end of the plug accommodates both circular and rectangular bores that are normally provided in the strike side of the door jamb. The plug is inserted into the edge bore of the door and the door is closed relative to the door jamb assembly. The plug is then moved in the edge bore so that the configured end engages the bore in the strike side to thus secure the door in the closed position. Slots provided in the configured end of the plug are arranged to receive a retention tab to secure the plug in position. The retainer is particularly suited for door jamb assemblies that have a blind bore in the strike side.

4 Claims, 2 Drawing Sheets

DOOR RETAINER FOR PRE-HUNG DOOR

FIELD OF THE INVENTION

This invention relates to doors pre-hung on frames that are arranged for side lights and more particularly relates to a door retainer for securing a pre-hung door in a closed position relative to a frame.

BACKGROUND INFORMATION

It is common practice to manufacture doors that are pre-hung in a frame. This simplifies the installation and reduces the cost. The door is secured to the frame to prevent damage during shipment and handling. Currently, door retainers such as the door retainer of U.S. Pat. No. 5,159,782, are utilized to secure the pre-hung door and the frame in position relative to each other. The door retainer is generally of a plastic material and is configured to fit into the edge bore of the door and is movable to extend into the bore in the strike side of the frame provided for the latch mechanism. The retainer is threaded internally to receive a threaded locking member. The retainer is configured so that it may be inserted into the edge bore of the door through the door's face bore. The retainer is of sufficient length to extend into the bore of the strike jamb. Extending lobes on the retainer engage the arc surface of the face bore of the door to limit the entry of the retainer in the edge bore. The threaded locking member is then inserted through the backside of the bore in the strike jamb and is threadably installed in the threaded end of the retainer to effectively secure the door and frame one to the other.

U.S. Pat. No. 4,483,101, Berzina is a retaining strap for securing a pre-hung door in a closed position. The strap has a projection on one end that is inserted through the face bore of the door to reside in the end of the edge bore of the door adjacent the face bore. The strap is then wrapped under tension around the face of the door and the lock set lamb and is secured to the face of the lock set jamb as by stapling. This type of retainer does not provide for positive latching of the door to the lock set jamb by engaging both the bore in the lock set jamb and the edge bore of the door. It relies on the tension of the strap as the securing apparatus.

Many of the pre-hung doors are, however, arranged for a side light, that is a window is to be provided adjacent either side of the door. The mullion for the window is secured to (or integrally formed with) the strike side of the door frame when the side light is to be provided adjacent the strike side. This prevents installation of the threaded locking member of the one type of retainer into the door retainer since the bore for the latch in the strike side does not extend through the window mullion. The strap type retainer is not suited since the stapling of the strap to the face of the window mullion would blemish the mullion.

It is just as desirable to secure a pre-hung door in a closed position relative to the frame when a side light is to be provided. All of the benefits of protecting the door and frame are realized when the door is secured. The present invention is a retainer that fills that need.

BRIEF SUMMARY OF THE INVENTION

The present invention is a retainer for securing a door to a frame when the door frame has a window mullion provided adjacent a strike side of the frame. The retainer of the present invention is readily installed and is arranged to secure the door to the frame for either of the standardized backsets.

A preferred embodiment of the present invention is a retainer that is slidably insertable into the edge bore of the door. The retainer is configured to fit into either the circular or rectangular bore provided in the strike side of the frame.

The retainer is inserted into the edge bore of the door with the door opened relative to the door frame sufficient to expose the edge bore of the door. The retainer is inserted such that an end of the retainer is substantially flush with the door edge. The door is then closed against the frame. The retainer, which is accessible through the face bore of the door is then moved to engage the bore provided in the strike side. A locking tab is inserted into a slot of the retainer to secure the retainer in position. The tab may, if desired, be secured to the edge of the strike side as by stapling.

DESCRIPTION OF THE PREFERRED EMBODIMENT

Figure 1:
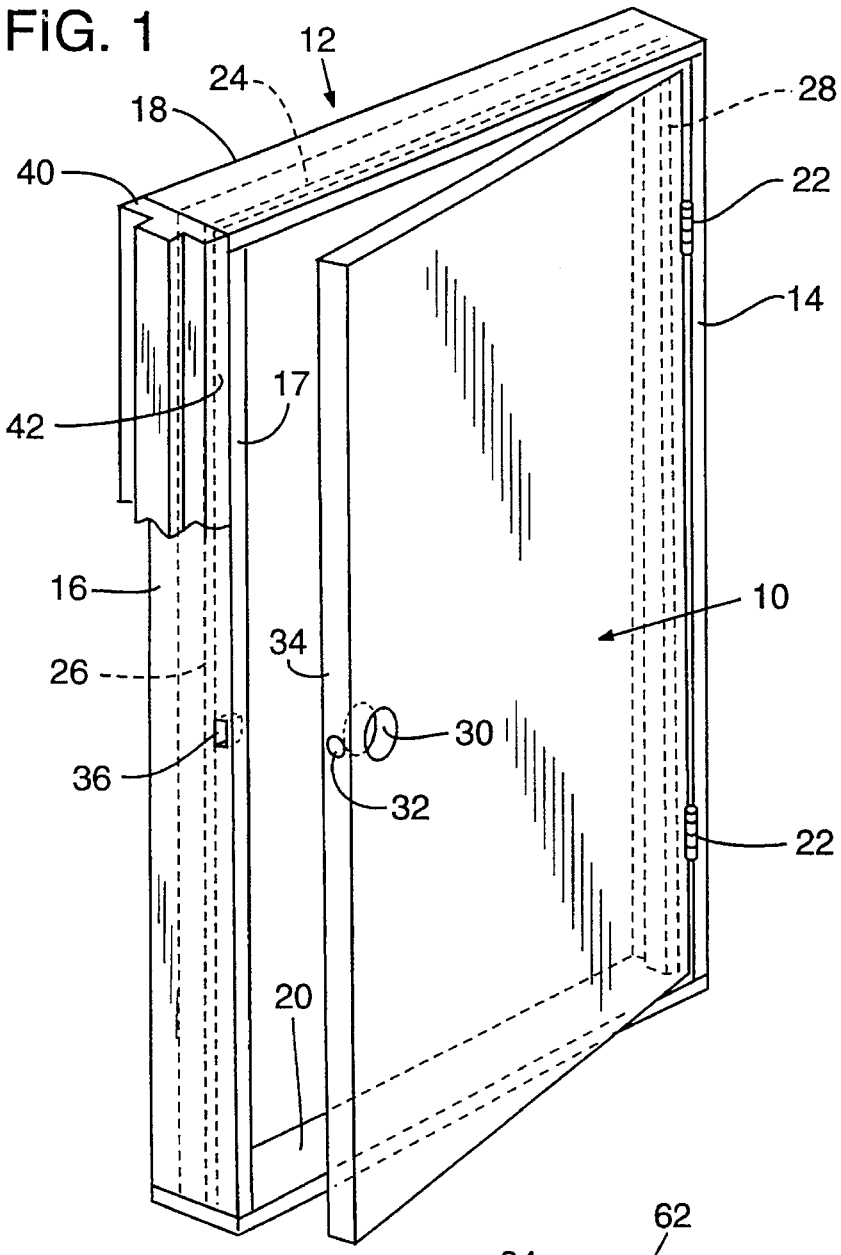
FIG. 1 is a view of a door pre-hung in a frame arranged for a side light adjacent a strike side of the frame.

FIG. 1 illustrates a door 10 pre-hung in a door jamb assembly (frame) 12. The door jamb assembly 12 includes a hinge side 14, a strike side 16, a header 18 and a sill (threshold) 20. Conventional rabbet joints are often utilized to secure the components of the door jamb assembly 12 together to provide structural integrity to the door jamb assembly. The door 10 is hung on the hinge side 14 by hinges 22 in a conventional manner. Conventional door stop moldings 24, 26 and 28 are fitted to surface of the door jamb assembly 12 as shown.

The door 10 and the strike side 16 are prepped or prepared for the mounting of a conventional door knob and lock assembly. The door 10 has a face bore 30 extending through the thickness of the door and an edge bore 32 that extends from the edge 34 of the door into the face bore 30. The face bore 30 in the door 10 has been standardized as a 2⅛ inch diameter bore and the center of the bore 30 is backset from the edge 34 of the door 10 at either 2⅜ inches or 2¾ inches. The edge bore 32 has been standardized as a one inch diameter bore.

The strike side 16 has a bore 36 that is strategically positioned to be aligned with the edge bore 32 of the door 10 when the door 10 is mounted to the door jamb assembly 12 and is in the closed position. The bore 36 has been standardized to be either a one inch diameter circular bore or a ¾ inch by one inch rectangular shaped bore.

In this embodiment, the door jamb assembly 12 is arranged to have a window installed adjacent the strike side 16. A window mullion 40 is fixedly attached to the strike side 16. It will be appreciated that the strike side 16 and the window mullion 40 may be formed as a single unit. As shown in FIG. 1, the bore 36 of the strike side 16 does not extend through the window mullion 40. The bore 36 is thus a blind bore.

Figure 2:
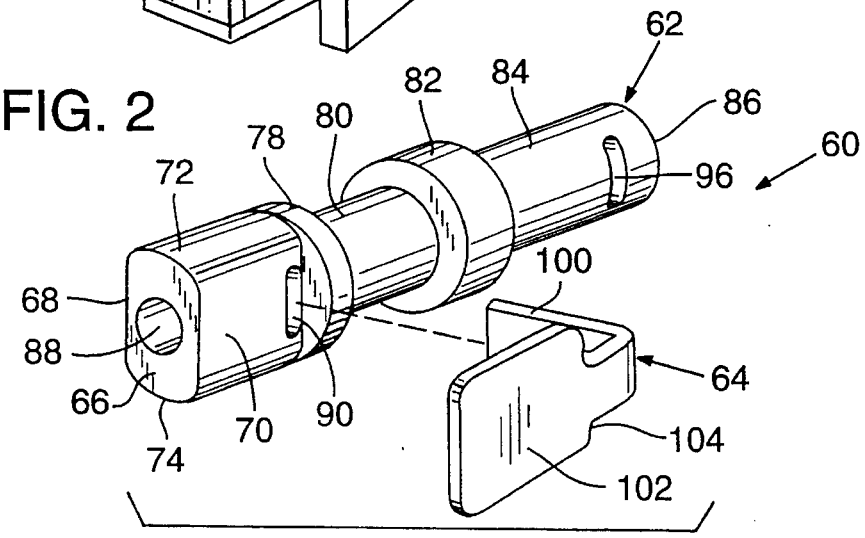
FIG. 2 is a view of a retainer of the present invention utilized to retain the door and frame of FIG. 1 one to the other.

FIG. 2 illustrates a retainer 60 of the present invention that is arranged to secure the door 10 in a closed position relative to the door jamb assembly 12. The retainer 60 includes a cylindrically shaped plug 62 and a retention tab 64 that are preferably molded of a light weight non-marring material such as plastic. An end 66 of the plug 62 has parallel chordal sides 68, 70 each of which connect with opposed arcuate sides 72, 74. The arcuate sides 72, 74 have a common center axis, i.e., the axis of the cylindrical plug 62, and have a radius closely corresponding to the radius of the edge bore 32 of the door 10. The end 66 of the plug 62 is arranged to fit either of the standardized bores that are provided in the strike side 16. The radius of the arcuate sides 72, 74 corresponds closely to the radius of a standardized circular bore 36 that may be provided in the strike side 16 and the distance between the arcuate sides 72,74 corresponds closely to the major dimension (length) of a standardized rectangular bore that may be provided in the strike side 16. The distance between the parallel sides 68, 70 corresponds closely to the minor dimension (width) of a standardized rectangular bore 36 that may be provided in the strike side 16. The plug 62 will thus accommodate either of the two standardized bores provided in the strike side 16.

A circular portion 78 is provided adjacent the formed end 66 of the plug 62. The portion 78 has a diameter that corresponds closely to the diameter of the edge bore 32 of the door 10. The plug 62 is reduced in diameter between the circular portion 78 and another circular portion 82 with the reduced diameter portion being designated by the numeral 80. The circular portion 82 also corresponds closely to the diameter of the edge bore 32 of the door 10. Another reduced diameter portion 84 extends from the circular portion 82 to the end 86 of the plug 62. The diameter of the portion 84 is substantially the same as the diameter of the reduced diameter portion 80. It will be appreciated that the reduced diameter portions 80, 84 may be of other geometric shapes other than cylindrical such as square, rectangular, triangular and so forth.

The plug 62 has a through center bore 88 extending along its longitudinal axis. The bore 88 is provided to reduce the material required to produce the plug 62 and also reduces its weight. Slots 90 are provided in each of the sides 68, 70 of the formed end 66 of the plug 62 and are adjacent the circular portion 78 substantially as shown in FIG. 2. The slots 90 in the sides 68, 70 are aligned one with the other and are basically centrally positioned relative to the longitudinal axis of the plug 62.

Another pair of aligned slots 96 are provided in the cylindrical portion 84 near end 86 of the plug 62. The slots 96 have substantially the same dimensions as the slots 90 and each are sized to accommodate an extending ear 100 of the retention tab 64 as will be later explained.

The retention tab 64 is a thin el shaped member that has an ear 100 extending substantially normal to an end 104 of a body 102. As shown, the ear 100 and the body 102 are basically rectangular in shape. The ear 100 is dimensioned to fit snugly in either the slots 90 or the slots 96 of the plug 62.

Figure 3:
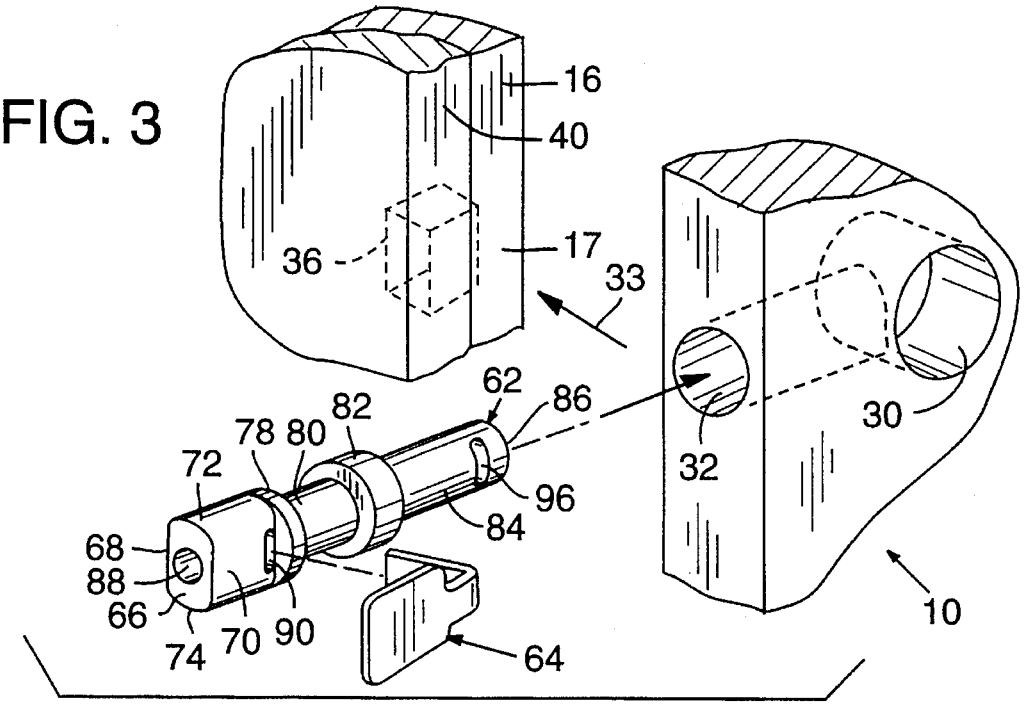
FIG. 3 is a partial view of the door of FIG. 1 and the retainer of FIG. 2 illustrating the manner of installing the retainer.
Figure 4:
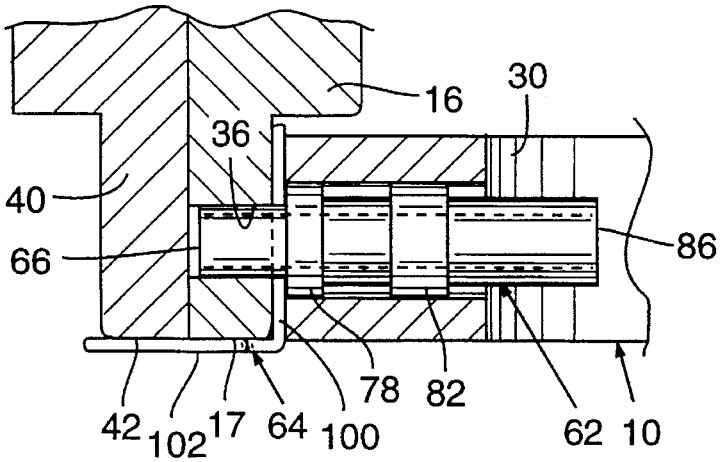
FIG. 4 is a sectional view of the door and frame of FIG. 1 showing the retainer of FIG. 2 installed to secure the door to the frame; and, FIGS. 5 and 6 illustrate the retainer of the present invention of FIG. 2 in relation to the standard backsets of the face bore of the door of FIG. 1.
Figure 5:
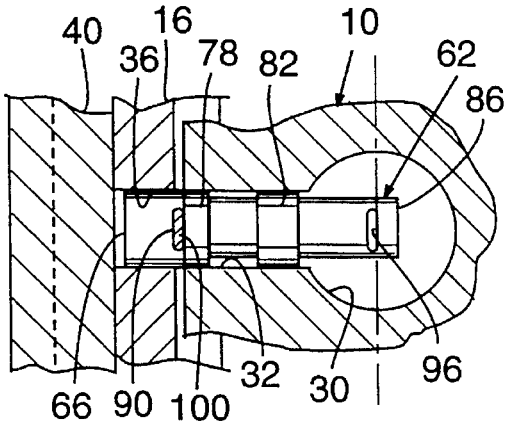
Figure 6:
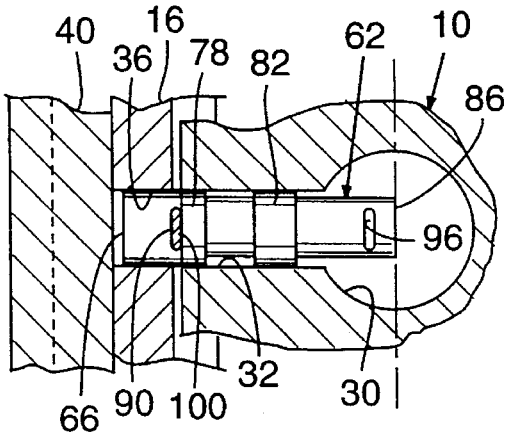

FIG. 3 is a view showing the door 10 partially opened relative the door jamb assembly 12 to permit the insertion of the plug 62 into the edge bore 32 of the door 10. The end 86 of the plug 62 is inserted first into the edge bore 32. The plug 62 is of a strategic length so that the plug may be inserted into the edge bore 32 a sufficient distance to place the end 66 of the plug 62 substantially flush with the edge 34 of the door 10. The end 86 of the plug 62 will be received in the face bore 36 of the door 10 as best seen in FIGS. 4, 5 and 6. The plug 62 is of a length to be installed in this manner for either of the standardized backsets of the face bore 30 of the door 10.

The plug 62 is preferably installed in the edge bore 32 with the sides 68, 70 substantially parallel with the face of the door 10. Positioning the sides 68, 70 substantially parallel to the face of the door 10 provides access to the slots 90, 96 and in the event the bore 36 in the strike side 16 is rectangular, properly positions the end 66 of the plug 62 for the ultimate insertion into the bore 36. The slots 96 in the plug 62, however facilitate rotating the plug 62 to properly align the formed end 66 with the bore 36 in the strike side 16 in the event the sides 68, 70 are not parallel with the face of the door 10. The extending ear 100 of the retaining tab 64 is inserted into the slots 96 to rotate the plug 62 as required. It will be appreciated that other similar tools may also be utilized to rotate the plug 62 as required, however it is preferable to use the retaining tab 64 since it is of a non-marring material. It is also preferable to leave the retaining tab in engagement with the slots 96 to facilitate moving the plug 62 into engagement with the bore 36 of the strike side 16 after the door 10 has been closed relative the frame assembly 12.

The door 10 is then moved to the closed position relative to the door jamb assembly 12 as indicated by arrow 33. The plug 62 is moved into engagement with the bore 36 of the strike side 16 as shown in FIGS. 4, 5 and 6. FIG. 5 illustrates a face bore 30 of the door 10 having a 2⅜ inch backset and FIG. 6 illustrates a face bore 30 of the door 10 having a 2¾ inch backset. The end 66 of the plug 62 is arranged to fit into either of the standardized bores provided in the strike side 16, whether it be a circular bore or a rectangular bore. The retaining tab 64 fitting in slots 96 is utilized to move the plug 62 into the bore 36. The plug 62 is moved a sufficient distance so that the slots 90 will be exposed in the space between the door 10 and the strike side 16.

The retaining tab 64 is then removed from the slots 96 and the ear 100 of the tab 64 is inserted into the exposed slots 90 of the plug 62. The tab 64 is installed in the slots 90 such that the body 102 of the tab 64 will be in abutment with the edge 17 of the strike side 16 and an edge 42 of the window mullion 40. The door 10 is now secured to the door jamb assembly 12 and is ready for transport or other handling. The ear 100 fits snugly enough in the slots 90 of the plug 62 so that additional fasteners are generally not required. The body 102 of the tab 64 may however be secured to the edge 17 of the casing 16 and/or the edge 42 of the window mullion 40 by a fastener such as a staple.

The circular portions 78, 82 (referred to as cinch rings) of the plug 62 being of substantially the same diameter as the edge bore 32 in the door 10 prevent any movement of the plug transverse to the longitudinal axis of the bore 32. The reduced diameter portion 80 reduces the frictional engagement between the plug 62 and the bore 32 to facilitate slidably moving the plug in the bore 32. This arrangement provides for ease of movement of the plug 62 in the bore 32 to facilitate the installation and the subsequent removal of the plug 62. The circular portion 82 (cinch ring) is strategically positioned on the plug 62 so that the circular portion 82 will reside within the edge bore 32 of the door 10 for either of the standardized backsets of the face bore 30 when the plug 62 is installed to secure the door 10 to the door frame assembly 12.

The ease of moving the plug 62 in the bore 32 to be in engagement with the bore 36 of the strike side 16 or out of engagement with the bore 36 is also an aid to an installer setting the door 10 and door jamb assembly 12 in a door opening. The installer, upon removal of the retaining tab 64 from the slots 90, is able to easily move the plug 62 (in the bore 32) into and out of engagement with the bore 36 in the strike side 16. The plug 62 thus servers as a temporary latch mechanism for the installer. The ear 100 of the retaining tab 64 may be utilized to engage the slots 96 of the plug 62 to readily move the plug 62 as required.

Those skilled in the art will recognize that modifications and variations may be made without departing from the true spirit and scope of the invention. The invention is therefore not to be limited to the embodiments described and illustrated but is to be determined by the appended claims.

What is claimed is:

1. A door and door jamb assembly wherein the door is pre-hung on the door jamb assembly by hinges and the door and a strike side of the door jamb assembly are prepped to receive a lock set whereby a cylindrical face bore extends through the door and a cylindrical edge bore extends from the face bore to a door edge and a blind bore is formed in the strike side of the door jamb assembly, and a retainer for retaining the door and door jamb in a closed position for shipping and handling of the assembly, the retainer comprising:

an elongate plug having a length, a width and opposed first and second ends, said plug configured to be insertable lengthwise through the edge bore with the first end projected into the face bore of the door, and said plug being axially movable in said edge bore between a first position whereat the plug is inserted with the second end not projected from the door edge and a second position with the second end projected from the door edge and into the blind bore of the door jamb, the second end of the plug configured to fit in the blind bore of the strike side and said plug configured to have a fastener portion at a position in the plug located between the door edge and door jamb with the plug in its second position; and, a separate restricting member configured to have a fastener portion mated to the fastener portion of the plug and insertable between the door edge and door jamb and into fastening engagement with the plug in said second position to thereby prevent axial movement of the plug said fastener portion of the plug including a slot provided in the plug through its width;

and said fastener portion in the restricting member including a retention tab insertable into the slot and thereby preventing axial movement of the plug.

2. A retainer for a door and door jamb assembly as defined in claim 1, wherein:

the second end is configured to have two parallel chordal sides connected to two opposed arcuate sides for fitting a round shape or rectangular shape blind bore in the door jamb.

3. A retainer for a door and door jamb assembly as defined in claim 2, wherein:

the plug is configured throughout its length for slidable insertion through the edge bore.

4. A retainer for a door and door jamb assembly as defined in claim 3, wherein:

a second slot is provided through the plug width near the first end and exposed through the face bore and thereby accessible for insertion of said tab whereby said retainer is secondarily a tool for engaging and moving said plug between said first and second positions.

* * * * *